US008016601B2

(12) United States Patent
Masumoto et al.

(10) Patent No.: US 8,016,601 B2
(45) Date of Patent: Sep. 13, 2011

(54) CAP AND CONNECTOR UNIT

(75) Inventors: Toshio Masumoto, Tokyo (JP); Yukiko Sato, Tokyo (JP)

(73) Assignee: Japan Aviation Electronics Industry Limited, Tokyo (JP)

( * ) Notice: Subject to any disclaimer, the term of this patent is extended or adjusted under 35 U.S.C. 154(b) by 0 days.

(21) Appl. No.: 12/711,393

(22) Filed: Feb. 24, 2010

(65) Prior Publication Data

US 2010/0227487 A1 Sep. 9, 2010

(30) Foreign Application Priority Data

Mar. 5, 2009 (JP) ..... 2009-052168

(51) Int. Cl.
*H01R 13/44* (2006.01)

(52) U.S. Cl. ..... 439/147; 439/940

(58) Field of Classification Search ..... 439/41, 439/135, 147, 940
See application file for complete search history.

(56) References Cited

U.S. PATENT DOCUMENTS 6,236,575 B1 * 5/2001 Ritter ..... 361/819
7,828,564 B2 * 11/2010 Guan et al. ..... 439/135
2006/0134952 A1 * 6/2006 Meister et al. ..... 439/148

FOREIGN PATENT DOCUMENTS

JP 2002-124339 A 4/2002

* cited by examiner

*Primary Examiner* — T C Patel
*Assistant Examiner* — Travis Chambers
(74) *Attorney, Agent, or Firm* — Holtz, Holtz, Goodman & Chick, PC

(57) ABSTRACT

A cap which is made difficult to come off a connector by suppressing deformation of the cap. The cap includes an insertion portion that has a hollow cylindrical shape and is inserted in a shell body of a shell of a receptacle connector, and a cover portion which is continuous with the insertion portion and covers an opening of the shell body. Ribs are formed inside the insertion portion, for suppressing deformation of the insertion portion.

2 Claims, 11 Drawing Sheets

CAP AND CONNECTOR UNIT

BACKGROUND OF THE INVENTION

1. Field of the Invention

This invention relates to a cap and a connector unit including the cap.

2. Description of the Related Art

As a conventional cap which is mounted on a connector, there has been proposed one disclosed in Japanese Laid-Open Patent Publication (Kokai) No. 2002-124339. A receptacle connector is disposed on a printed circuit board in a state in which an opening of a fitting portion thereof is directed up, and hence it is not possible to attract the receptacle connector by a mounter. To make it possible to attract the receptacle connector by the mounter, a cap is removably mounted on the fitting portion.

The cap disclosed in Japanese Laid-Open Patent Publication (Kokai) No. 2002-124339 is mounted on an outer periphery of an upper portion of the fitting portion in a manner covering the opening of the fitting portion.

As another conventional cap, there has been proposed a cap which is comprised of an insertion portion having a hollow cylindrical shape, which is inserted in a fitting portion of a receptacle connector, and a cover portion which covers an opening of the fitting portion. The insertion portion and the cover portion are integrally formed of a resin.

Further, a receptacle connector of a certain type includes a locking spring for preventing a plug connector from coming off. A front portion of the locking spring protrudes into a fitting portion of the receptacle connector. When the plug connector is fitted to the receptacle connector including the locking spring, the locking spring of the receptacle connector is engaged with a hole of the plug connector, whereby the plug connector is locked to the receptacle connector.

If the cap is mounted on the receptacle connector, it is possible to attract the receptacle connector by the mounter via the cap, to thereby dispose the receptacle connector on a predetermined position on the printed circuit board. It should be noted that when the cap is mounted on the receptacle connector, the locking spring of the receptacle connector presses the outer peripheral surface of the insertion portion of the cap, whereby the cap is positively held by the receptacle connector.

The printed circuit board on which the receptacle connector is disposed is conveyed to a reflow furnace, and the receptacle connector is soldered to the printed circuit board.

However, since the cap is made of a resin, if the cap is heated in the reflow furnace, the cap is liable to be deformed, and further, in a case of a connector provided with a locking mechanism, the stress of the locking spring is applied to the outer peripheral surface of the insertion portion of the cap, and hence the cap is further deformed.

As a consequence, for example, when the printed circuit board is conveyed after the receptacle connector is soldered thereto, or when the printed circuit board is inverted upside down to mount other electronic components on a surface opposite to a surface on which the receptacle connector is mounted, there is a case where the cap falls off the receptacle connector.

SUMMARY OF THE INVENTION

The present invention has been made in view of these circumstances, and an object thereof is to provide a cap which is made difficult to come off a connector by suppressing deformation of the cap, and a connector unit including the cap.

To attain the above object, in a first aspect of the present invention, there is provided a cap for being removably mounted on a fitting portion of a connector that receives a mating connector, comprising an insertion portion that has a hollow cylindrical shape, and is inserted into the fitting portion, a cover portion that is continuous with the insertion portion, and covers an opening of the fitting portion, and a reinforcing portion that suppresses deformation of the insertion portion.

With the arrangement of the cap according to the first aspect of the present invention, deformation of the insertion portion is suppressed by the reinforcing portion, whereby the cap is made difficult to come off the connector.

Preferably, the reinforcing portion is formed on an inner peripheral surface of the insertion portion at a location corresponding to a location on an outer peripheral surface of the insertion portion where a spring piece formed on the fitting portion is engaged.

Preferably, the spring piece is a locking spring piece for locking the mating connector.

To attain the above object, in a second aspect of the present invention, there is provided a connector unit, comprising a connector including a fitting portion that receives a mating connector, and a cap removably mounted on the fitting portion, the cap including an insertion portion that has a hollow cylindrical shape, and is inserted into the fitting portion, a cover portion that is continuous with the insertion portion, and covers an opening of the fitting portion, and a reinforcing portion that suppresses deformation of the insertion portion, the fitting portion having a spring piece for being engaged with an outer peripheral surface of the insertion portion, the reinforcing portion being formed on an inner peripheral surface of the insertion portion at a location corresponding to a location on the outer peripheral surface of the insertion portion where the spring piece is engaged.

With the arrangement of the connector unit according to the second aspect of the present invention, the fitting portion includes the spring piece which is engaged with the outer peripheral surface of the insertion portion, and hence the urging force of the spring piece acts on the outer peripheral surface of the insertion portion, whereby the cap is positively held by the connector. Further, since the reinforcing portion is formed on the inner peripheral surface of the insertion portion at a location corresponding to a location on the outer peripheral surface of the insertion portion where the spring piece is engaged, as described above, the reinforcing portion receives the returning force of the spring piece, whereby deformation of the cap is positively suppressed.

Preferably, the spring piece extends in a connector fitting direction, and a front end portion of the spring piece is located in the vicinity of the opening of the fitting portion.

Preferably, the spring piece is a locking spring piece for locking the mating connector.

According to these preferred embodiments, deformation of the cap is suppressed, whereby the cap is made difficult to come off the connector.

The above and other objects, features and advantages of the present invention will become more apparent from the following detailed description taken in conjunction with the accompanying drawings.

DETAILED DESCRIPTION OF THE PREFERRED EMBODIMENTS

The present invention will now be described in detail with reference to the drawings showing preferred embodiments thereof.

Referring to FIGS. 1, 2, 3, and 6, a connector unit 1 is comprised of a receptacle connector 3 and a cap 9.

Figure 1:
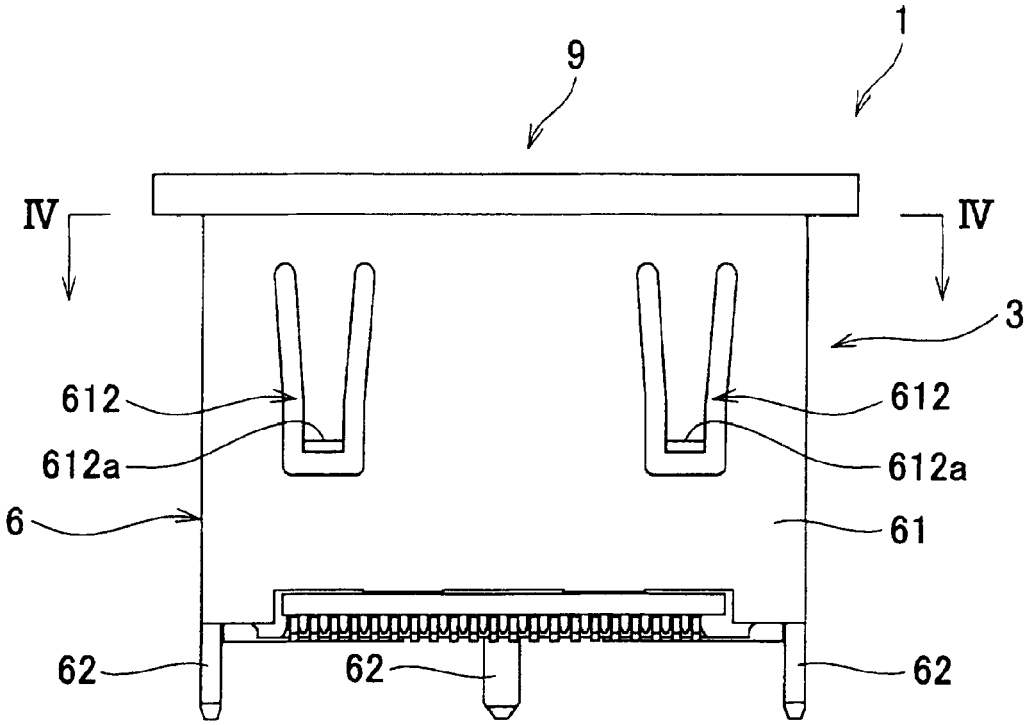
FIG. 1 is a front view of a connector unit according to an embodiment of the present invention.
Figure 2:
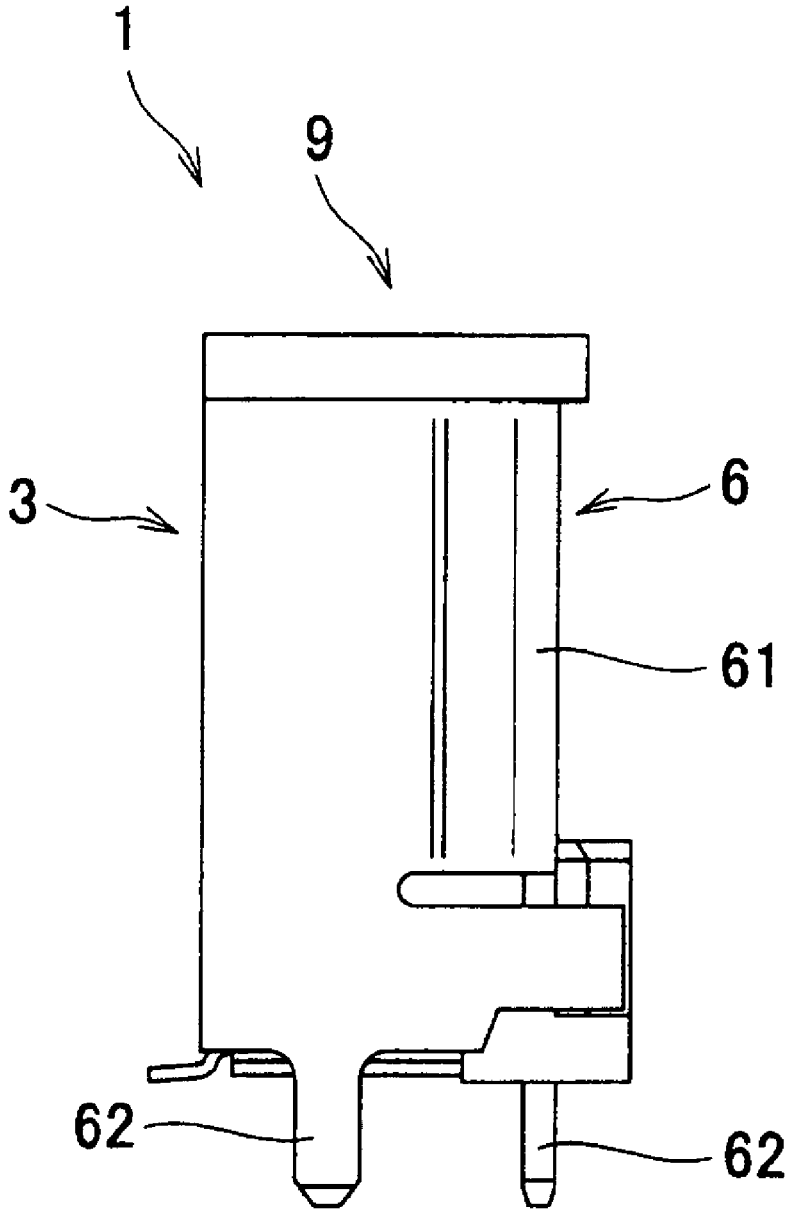
FIG. 2 is a side view of the connector unit shown in FIG. 1.
Figure 3:
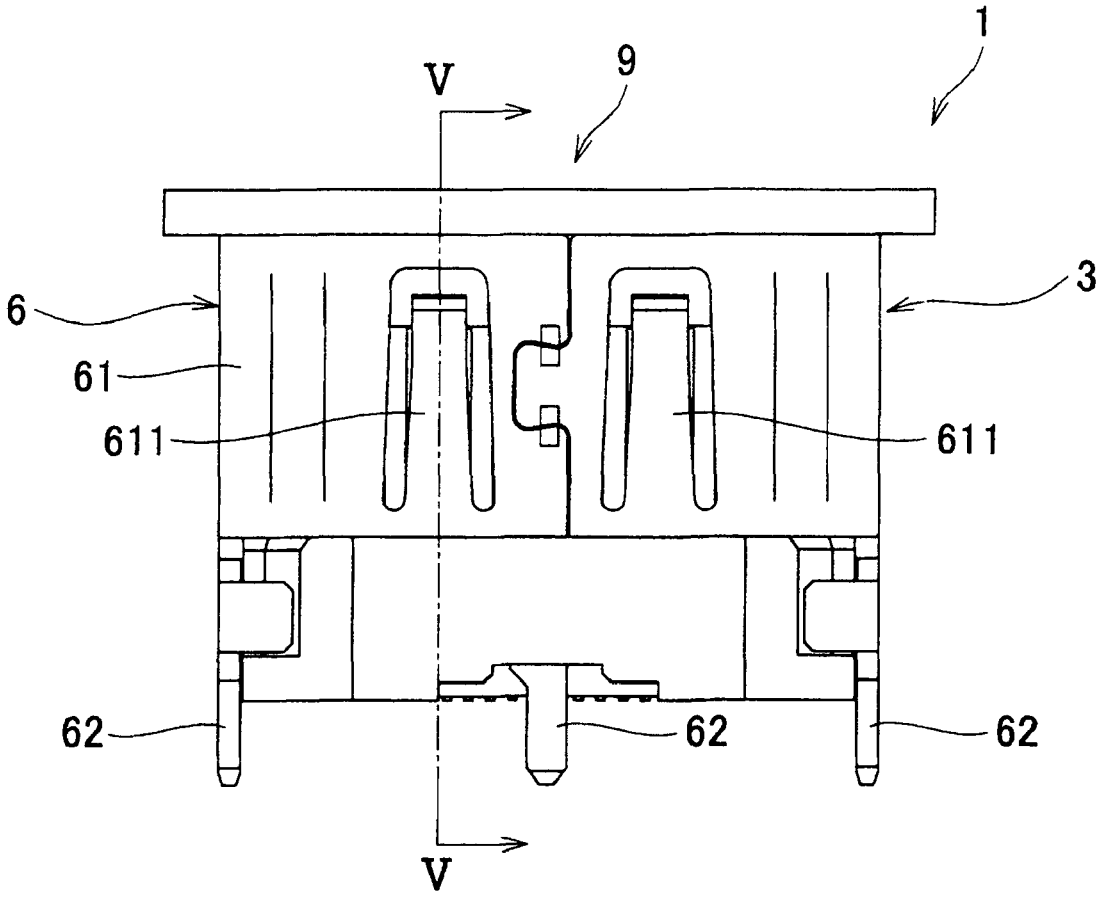
FIG. 3 is a rear view of the connector unit shown in FIG. 1.
Figure 4:
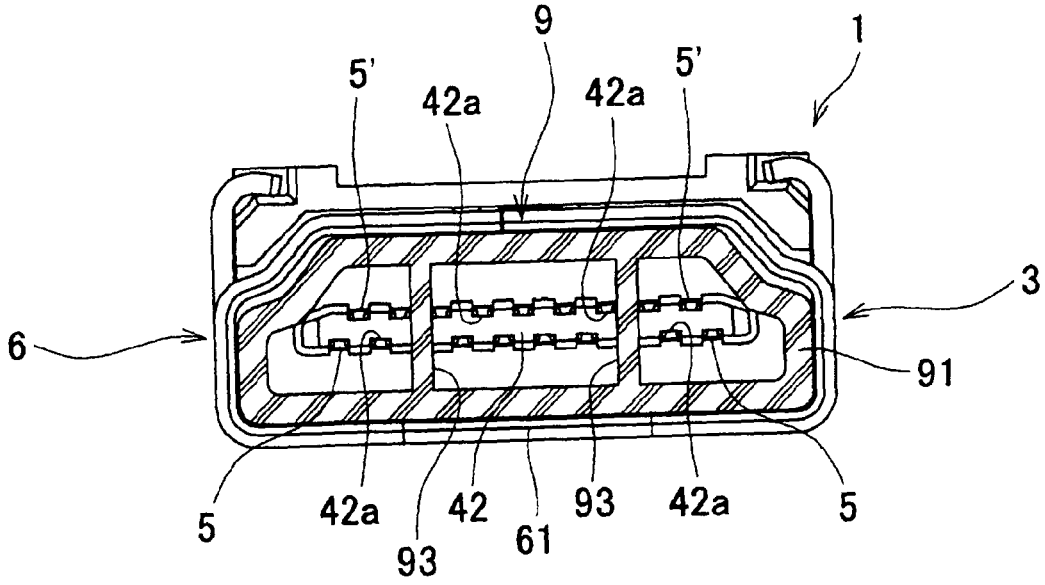
FIG. 4 is a cross-sectional view taken along line IV-IV in FIG. 1, from which terminal portions are omitted.
Figure 5:
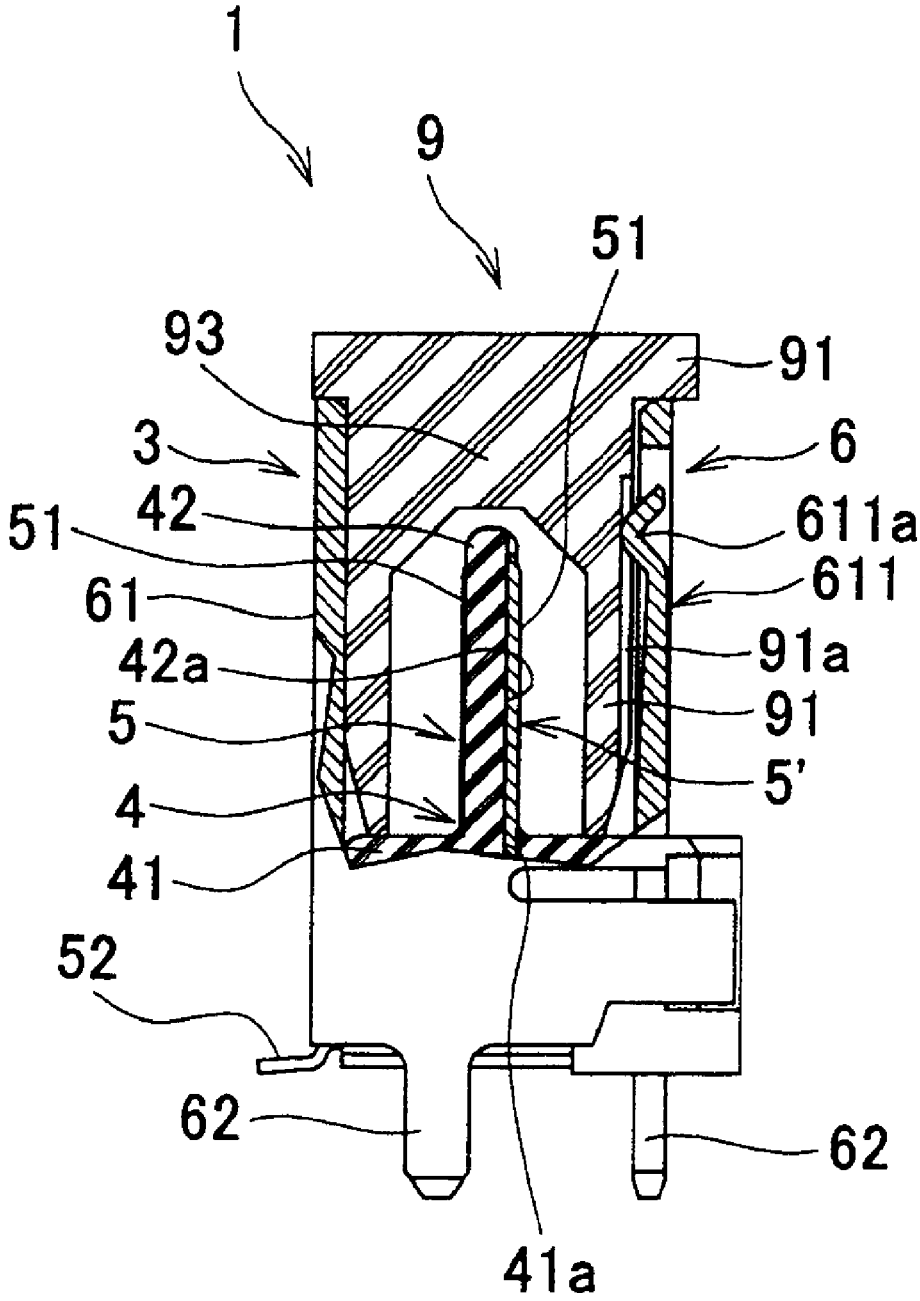
FIG. 5 is a partial cross-sectional view taken along line V-V in FIG. 3.
Figure 6:
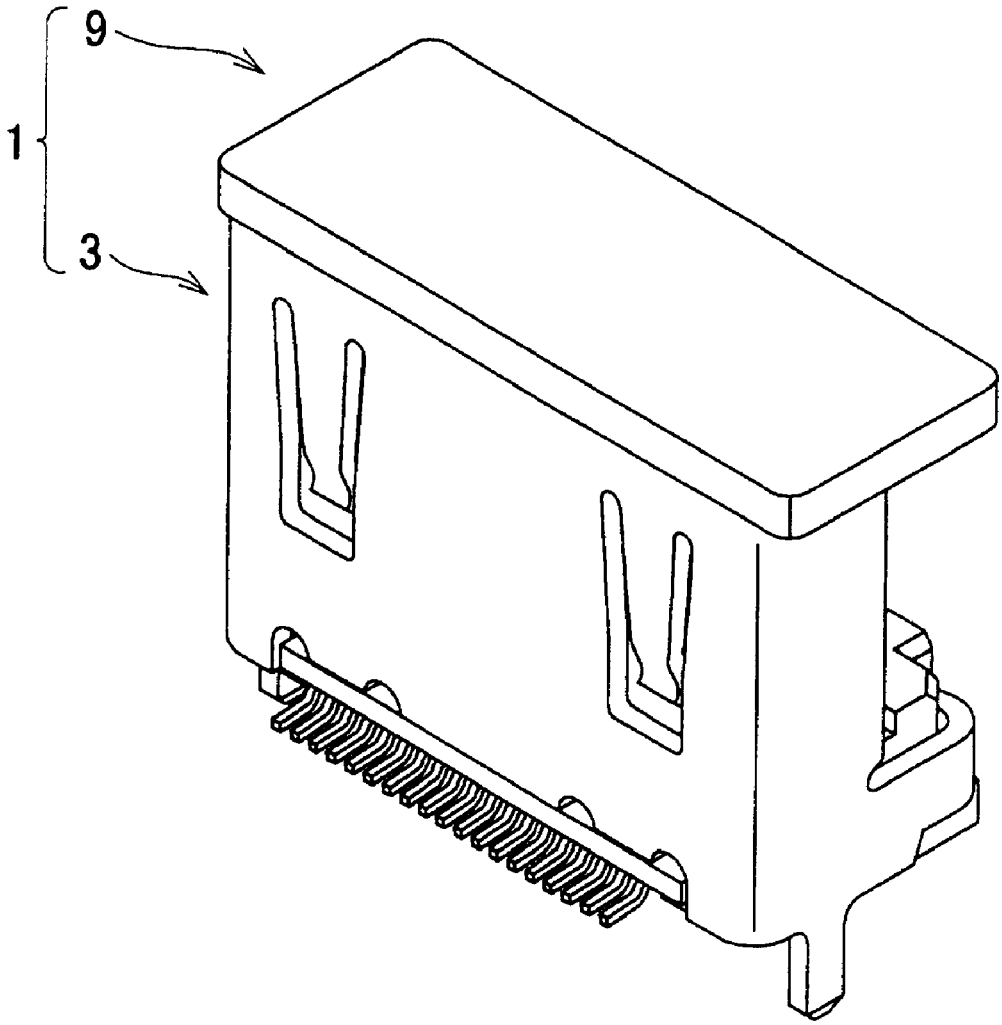
FIG. 6 is a perspective view of the connector unit shown in FIG. 1.
Figure 7:
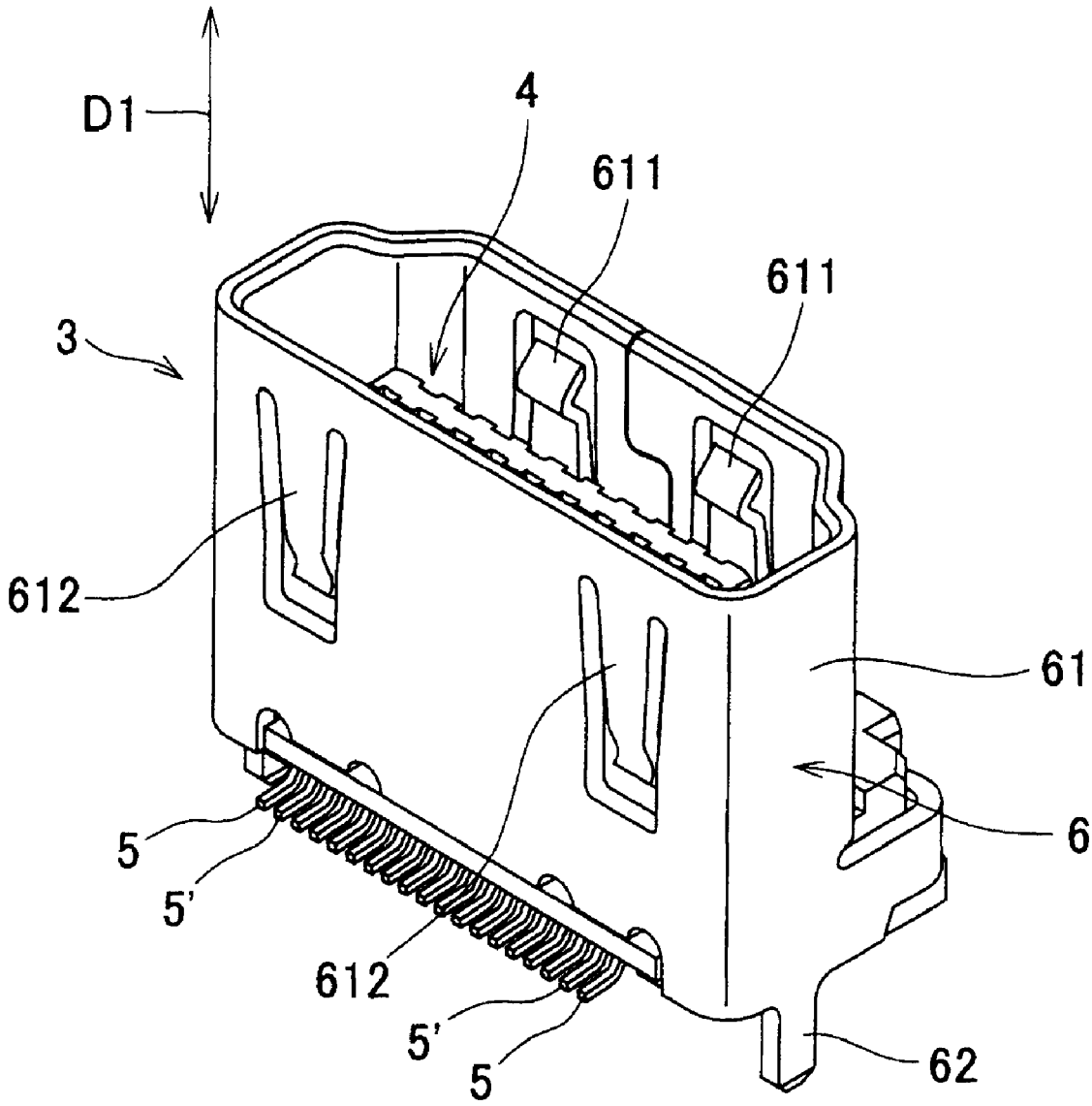
FIG. 7 is a perspective view of the connector unit shown in FIG. 1 in a state in which a cap is removed from the connector unit.
Figure 8:
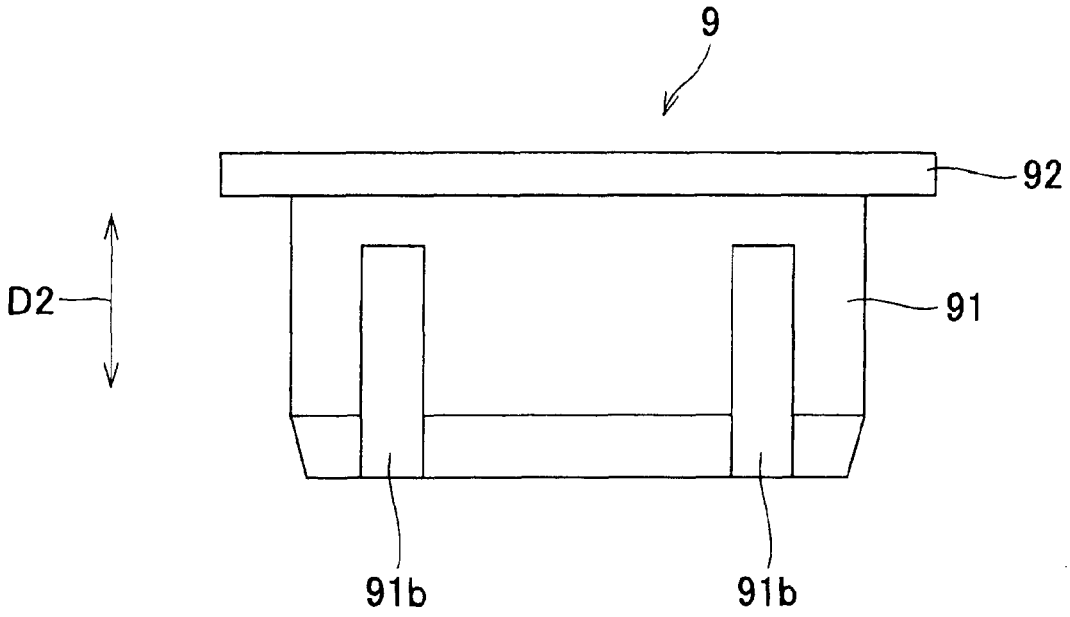
FIG. 8 is a front view of the cap of the connector unit shown in FIG. 1.
Figure 9:
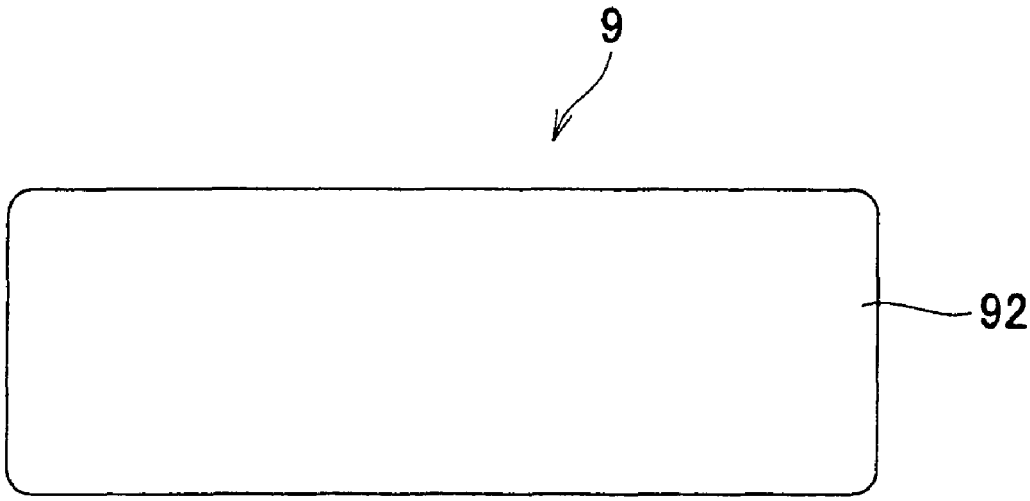
FIG. 9 is a plan view of the cap shown in FIG. 8.
Figure 10:
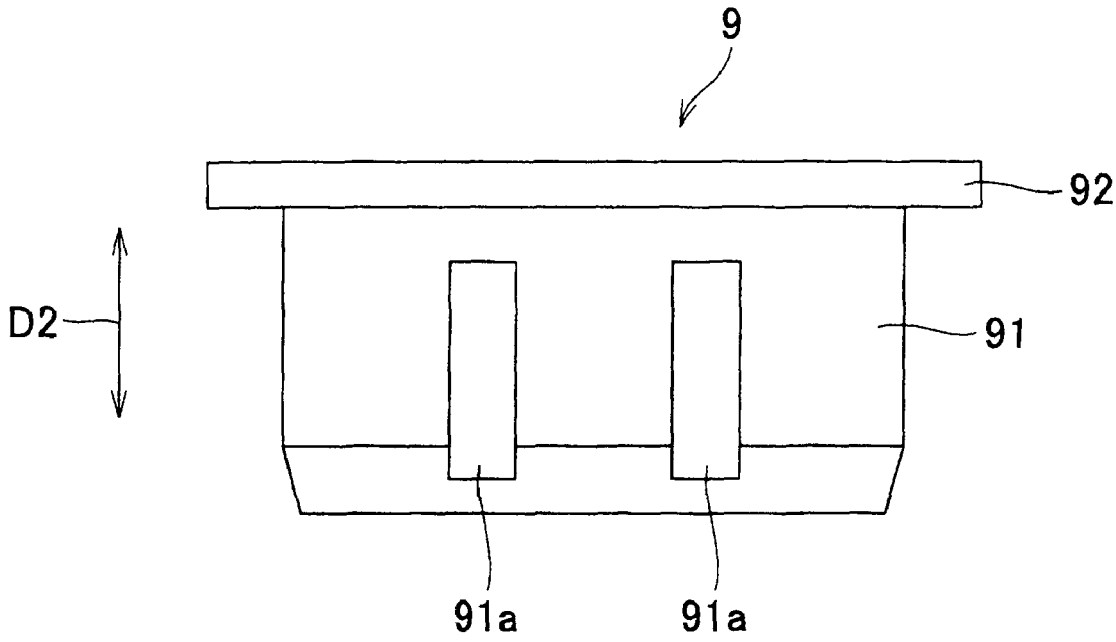
FIG. 10 is a rear view of the cap shown in FIG. 8.
Figure 11:
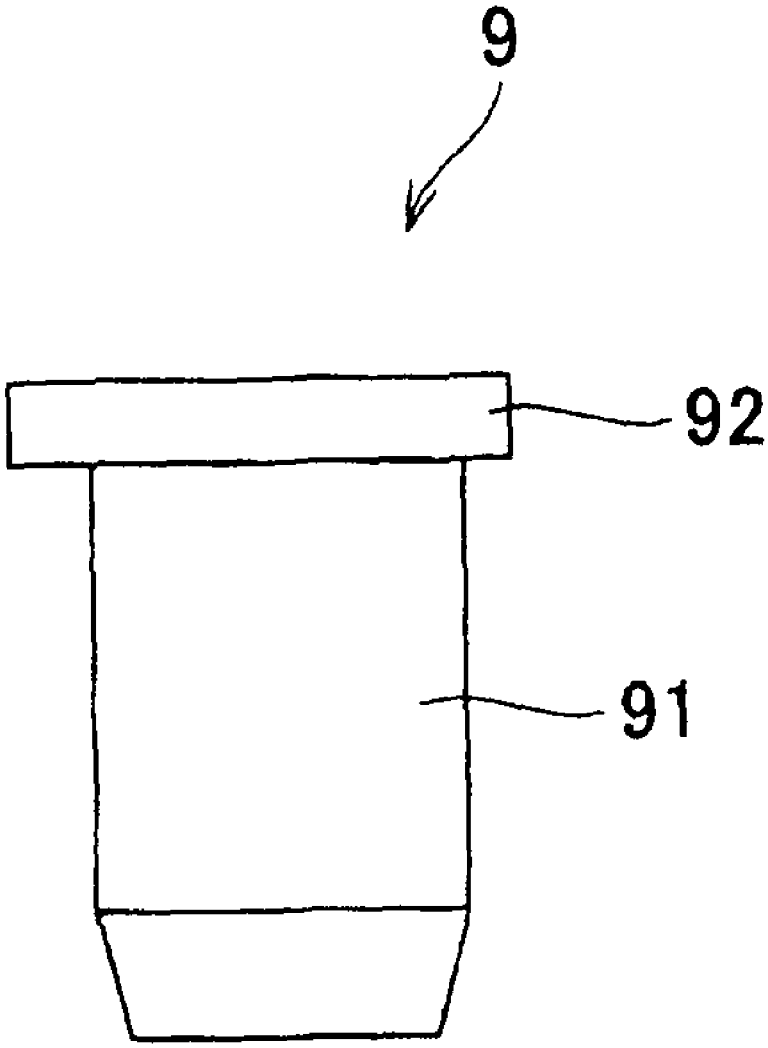
FIG. 11 is a side view of the cap shown in FIG. 8.

Referring to FIGS. 4, 5, and 7, the receptacle connector 3 includes a housing 4, contacts 5 and 5', and a shell 6. The receptacle connector 3 is a connector of the standard of HDMI (High-Definition Multimedia Interface).

The housing 4 is integrally formed of a synthetic resin, and includes a bottom board portion 41, a contact-arranging portion 42. The bottom board portion 41 is substantially plate-shaped. The contact-arranging portion 42 is substantially plate-shaped, and is perpendicularly continuous with the bottom board portion 41. The contact arranging portion 42 has a front surface (surface on the left side of the contact arranging portion 42 as viewed in FIG. 5) and a rear surface (surface on the right side of the contact arranging portion 42 as viewed in FIG. 5) both formed with grooves 42*a* at equally-spaced intervals. The grooves 42*a* in the front surface of the contact arranging portion 42 and the grooves 42*a* in the rear surface of the contact arranging portion 42 are displaced by half a pitch in the direction of arrangement of the grooves 42*a*.

Each of the contacts 5 includes a contact portion 51, a terminal portion 52, and a connecting portion (not shown). Each contact 5 is formed by blanking and bending a metal plate having conductivity and elasticity. The contact portion 51 is accommodated in an associated one of the grooves 42*a* in the front surface of the contact arranging portion 42. The surface of the contact portion 51 protrudes from the associated groove 42*a*. The contact portion 51 is brought into contact with a contact portion of an associated one of contacts of a mating connector, not shown. The terminal portion 52 is bent at a substantially right angle, and a front end portion thereof protrudes forward (leftward as viewed in FIG. 5) from the housing 4. The terminal portion 52 is soldered to a pad on a printed circuit board, not shown. The connecting portion connects between the contact portion 51 and the terminal portion 52. The connecting portion is press-fitted into an associated one of holes 41*a* formed in the bottom board portion 41 of the housing 4.

Each of the contacts 5' includes the contact portion 51, the terminal portion 52, and the connecting portion, not shown, and has substantially the same shape and size as those of each contact 5. A difference between each contact 5' and each contact 5 is that the connecting portion of the contact 5' is longer than that of the contact 5. The terminal portion 52 of the contact 5' protrudes forward from the housing 4, similarly to the terminal portion 52 of the contact 5. Therefore, the terminal portions 52 of the contacts 5 and the terminal portions 52 of the contacts 5' are arranged in an alternating manner on a front side of the receptacle connector 3 (left side of the receptacle connector 3 as viewed in FIG. 5). The contact portion 51 of each contact 5' is accommodated in an associated one of the grooves 42*a* of the rear surface of the contact arranging portion 42. The surface of the contact portion 51 of each contact 5' protrudes from the associated groove 42*a*. The connecting portion is press-fitted in an associated one of the holes 41*a* formed in the bottom board portion 41 of the housing 4.

As shown in FIGS. 1, 2, 3, 5, and 7, the shell 6 includes a shell main body (fitting portion) 61, and through hole terminals 62. The shell main body 61 has a substantially hollow cylindrical shape, and a transverse cross-section (cross-section along a direction orthogonal to a fitting/removing direction D1 (see FIG. 7) to/from the mating connector) has a substantially D shape. The shell 6 is formed by blanking and bending a metal plate having conductivity and elasticity.

The shell main body 61 has a rear surface formed with two locking spring pieces (spring piece) 611. The locking spring pieces 611 extend in the fitting/removing direction D1. Each locking spring piece 611 is capable of being elastically deformed in a direction of a thickness thereof. A front end portion 611*a* of each locking spring piece 611 is bent into a substantially L-shape. The front end portion 611*a* protrudes into the shell main body 61, and is engaged with an associated one of holes (not shown) of a shell of the mating connector which is inserted into the shell main body 61, to thereby lock a fitting portion of the mating connector.

The shell main body 61 has a front surface formed with two contact spring pieces 612. The contact spring pieces 612 extend in the fitting/removing direction D1 (see FIGS. 1 and 7). Each contact spring piece 612 is capable of being elastically deformed in a direction of a thickness thereof. A front end portion 612*a* of each contact spring piece 612 is bent into a substantially L-shape. The front end portion 612*a* of each contact spring piece 612 protrudes into the shell main body 61, and is brought into contact with the shell of the mating connector which is inserted into the shell main body 61.

The through hole terminals 62 are continuous with a lower end of the shell main body 61, and extend in the fitting/removing direction D1. Each of the through hole terminals 62 is soldered to an associated one of through holes in the printed circuit board. As a result, the shell 6 is mechanically fixed to the printed circuit board, and at the same time, is electrically grounded to the printed circuit board.

Referring to FIGS. 4, 5, 8, 9, 10, and 11, the cap 9 includes an insertion portion 91, a cover portion 92, and ribs (reinforcing portion) 93. The cap 9 is integrally formed of a synthetic resin. The cap 9 is mounted on the receptacle connector 3 to make it possible to attract the receptacle connector 3 by an attracting pad of a mounter, not shown, and further also serves to prevent dust, flux liquid or the like from entering the receptacle connector 3.

The insertion portion 91 has a substantially hollow cylindrical shape, and a transverse cross-section thereof has substantially the same shape as that of the shell main body 61, and is slightly smaller than the transverse cross-section of the shell main body 61. The insertion portion 91 is inserted in the shell main body 61. The insertion portion 91 has a rear surface (see FIG. 10) formed with two grooves 91*a*. The grooves 91*a* extend in an inserting/removing direction D2 (see FIG. 10). When the insertion portion 91 is inserted in the shell main body 61, the grooves 91*a* relatively receive the front end portions 611*a* of the locking spring pieces 611, to thereby weaken contact pressure of the front end portions 611*a* to the insertion portion 91. The insertion portion 91 has a front surface (see FIG. 8) formed with two grooves 91*b*. The grooves 91*b* extend in the inserting/removing direction D2 (see FIG. 8). When the insertion portion 91 is inserted into the shell main body 61, the grooves 91*b* relatively receive the front end portions 612*a* of the contact spring pieces 612, to thereby weaken contact pressure of the front end portions 612*a* to the insertion portion 91.

The cover portion 92 is substantially plate-shaped, and is continuous with an upper end of the insertion portion 91. When the insertion portion 91 is inserted in the shell main body 61, the cover portion 92 covers an opening of the shell main body 61.

As shown in FIGS. 4 and 5, each of the ribs 93 is substantially plate-shaped, and extends from a portion of the insertion portion 91 on a front side (left side as viewed in FIG. 5, lower side as viewed in FIG. 4) to a portion of the same on a rear side (right side as viewed in FIG. 5, upper side as viewed in FIG. 4). Each rib 93 is continuous with the insertion portion 91 and the cover portion 92. A portion of each rib 93 toward the housing (lower portion as viewed in FIG. 5) has a recess for avoiding interference of the contact arranging portion 42. The ribs 93 are on an inner peripheral surface of the insertion portion 91 at locations corresponding respectively to the grooves 91*a* of the insertion portion 91. That is, the ribs 93 are each located at the back of the associated one of the grooves 91*a* of the insertion portion 91, which are pushed by the front end portions 611*a* of the locking spring pieces 61, respectively, when the insertion portion 91 is inserted into the shell main body 61.

Next, a description will be given of an operation for mounting the connector unit 1 on the printed circuit board.

First, the cover portion 92 of the cap 9 mounted on the receptacle connector 3 is attracted by the attracting pad of the mounter, and the receptacle connector 3 is disposed at a predetermined location on the printed circuit board. At this time, the through hole terminals 62 of the shell 6 are inserted in the through holes in the printed circuit board, and the terminal portions 52 of the contacts 5 and 5' are disposed on the pad of the printed circuit board.

Next, the printed circuit board is conveyed to the reflow furnace, and the temperature of the inside of the reflow furnace is raised to a predetermined temperature to solder the receptacle connector 3 to the printed circuit board. At this time, the cap 9 is softened by heat, causing the portions of the insertion portion 91 pressed by the locking spring pieces 611 are about to be dented. However, the pressed portions are in a state reinforced by the ribs 93, and hence deformation of the cap 9 is suppressed. Further, the contact pressure of the locking spring pieces 611 becomes small due to the grooves 91*a*, and hence the deformation of the cap 9 is further suppressed.

Through the above-mentioned processing flow, electronic components including the receptacle connector 3 are mounted on one surface of the printed circuit board. If electronic components are also mounted on the other surface of the printed circuit board, it is necessary to invert the printed circuit board upside down. Since the cap 9 is hardly deformed, even if the printed circuit board is inverted upside down, the cap 9 does not come off the receptacle connector 3. Therefore, it is possible to prevent the cap 9 from falling off.

According to the present embodiment, the ribs 93 are formed on the inner peripheral surface of the insertion portion 91 at the locations corresponding respectively to the grooves 91*a* in the outer peripheral surface of the insertion portion 91, with which the locking spring pieces 611 are engaged. This causes the ribs 93 to receive the returning force of the locking spring pieces 611. As a consequence, the deformation of the cap 9 due to heating during a reflow soldering operation is positively suppressed. Therefore, when the printed circuit board on which the connector unit 1 is mounted is inverted upside down, or when the printed circuit board on which the connector unit 1 is mounted is conveyed, it is possible to prevent the cap 9 from falling off.

Further, the shell main body 61 of the shell 6 has the locking spring pieces 611 which are engaged with the grooves 91*a* of the insertion portion 91 of the cap 9, and hence the urging force of the locking spring pieces 611 acts on the outer peripheral surface of the insertion portion 91, whereby the cap 9 is positively held by the receptacle connector 3.

Further, once the cap 9 is mounted on the receptacle connector 3, it is possible not only to attract the receptacle connector 3 by the mounter but also to prevent liquid or dust from entering the receptacle connector 3 during the operation of mounting the connector unit 1 or during the conveying of the printed circuit board on which the connector unit 1 is mounted.

In the present embodiment, the ribs 93 as the reinforcing portion are formed on the inner peripheral surface of the insertion portion 91 at the locations corresponding respectively to the positions on the outer peripheral surface of the insertion portion 91, with which the locking spring pieces 611 are engaged. However, even if the locking spring piece 611 is located between the two ribs 93 in an arranging direction of the grooves 42, it is possible to suppress deformation of the cap 9, and hence it is not necessarily required to provide the reinforcing portions at the above-mentioned locations.

Further, although the connector unit 1 according to the present embodiment includes the locking spring pieces 611, the connector unit 1 may not have the locking spring pieces.

Although in the present embodiment, the two plate-shaped ribs 93 are employed as the reinforcing portion, the reinforcing portion is not limited to the two plate-shaped ribs 93, but may be prism-shaped or block-shaped reinforcing portion(s). That is, the shape of the reinforcing portion(s) is not limited to a plate-like shape, and the number of reinforcing portions is not limited, but may be one, or three or more.

Further, although in the present embodiment, the locking spring pieces 611 and the contact spring pieces 612 are formed at respective locations displaced from each other (locations displaced in the arranging direction of the grooves 42), the locking spring pieces 611 and the contact spring pieces 612 may be disposed in a manner opposed to each other via the insertion portion 91 in a manner sandwiching the ribs 93 as the reinforcing portion. Further, the shape and the number of the spring pieces are not limited to those of the spring pieces in the present embodiment.

It is further understood by those skilled in the art that the foregoing are the preferred embodiments of the present invention, and that various changes and modification may be made thereto without departing from the spirit and scope thereof.

What is claimed is:

1. A cap for being removably mounted on a fitting portion of a connector that is adapted to receive a mating connector, the cap comprising:

a cylindrical insertion portion which is insertable into the fitting portion of the connector and has a hollow space for preventing contact with a contact of said connector disposed inside said fitting portion;

a planar cover portion which is continuous with said insertion portion, and which is adapted to cover an opening of the fitting portion; and a reinforcing portion which suppresses deformation of said insertion portion;

wherein said reinforcing portion is approximately plate-like in shape and is formed on an inner peripheral surface of said insertion portion at a location corresponding to a location on an outer peripheral surface of said insertion portion at which a spring piece formed on the fitting portion of the connector is engageable;

wherein said reinforcing portion reaches another inner peripheral surface of the insertion portion which is in a mutually facing arrangement with said inner peripheral surface, and partitions the hollow space of the insertion portion;

wherein said reinforcing portion extends in a direction of action of a spring force of the spring piece; and wherein the spring piece comprises a locking spring piece for locking the mating connector.

2. A connector unit, comprising:

a connector which includes a fitting portion that is adapted to receive a mating connector; and a cap which is removably mounted on said fitting portion;

wherein said cap includes: (i) a cylindrical insertion portion which is insertable into the fitting portion of the connector and has a hollow space for preventing contact with a contact of said connector disposed inside said fitting portion, (ii) a planar cover portion which is continuous with said insertion portion, and which is adapted to cover an opening of said fitting portion, and (iii) a reinforcing portion which suppresses deformation of said insertion portion;

wherein said fitting portion includes a spring piece which is engageable with an outer peripheral surface of said insertion portion;

wherein said reinforcing portion is approximately plate-like in shape and is formed on an inner peripheral surface of said insertion portion at a location corresponding to a location on the outer peripheral surface of said insertion portion at which said spring piece is engageable;

wherein said reinforcing portion reaches another inner peripheral surface of the insertion portion in a mutually facing arrangement with said inner peripheral surface, and partitions the hollow space of the insertion portion;

wherein said reinforcing portion extends in a direction of action of a spring force of the spring piece;

wherein said spring piece extends in a connector fitting direction, and a front end portion of said spring piece is located in a vicinity of the opening of said fitting portion; and wherein said spring piece comprises a locking spring piece for locking the mating connector.

* * * * *